United States Patent [19]

Ohtsuka et al.

[11] Patent Number: 4,592,608

[45] Date of Patent: Jun. 3, 1986

[54] CONNECTOR FOR MEMORY CARDS

[75] Inventors: Hiroo Ohtsuka, Utsunomiya; Tomonari Ohtsuki, Mooka, both of Japan

[73] Assignee: Daiichi Denshi Kogyo Kabushiki Kaisha, Tokyo, Japan

[21] Appl. No.: 679,300

[22] Filed: Dec. 7, 1984

[30] Foreign Application Priority Data

Dec. 14, 1983 [JP] Japan ..... 58-191497[U]

[51] Int. Cl.[4] ..... H01R 13/629

[52] U.S. Cl. ..... 339/42; 339/75 MP

[58] Field of Search ..... 339/40, 42, 43, 75 M, 339/75 MP

[56] References Cited

U.S. PATENT DOCUMENTS

| | | | |
|---|---|---|---|
| 3,475,717 | 10/1969 | Lane | 339/75 MP |
| 3,763,459 | 10/1973 | Millis | 339/75 M |
| 4,403,819 | 9/1983 | Weber | 339/75 MP |
| 4,466,680 | 8/1984 | Sakai et al. | 339/75 M |
| 4,468,075 | 8/1984 | Tamura et al. | 339/75 M |
| 4,496,205 | 1/1985 | Christensen et al. | 339/75 M |

FOREIGN PATENT DOCUMENTS

| | | | |
|---|---|---|---|
| 2435262 | 1/1976 | Fed. Rep. of Germany | 339/43 |

*Primary Examiner*—John McQuade

*Attorney, Agent, or Firm*—Silverman, Cass & Singer, Ltd.

[57] ABSTRACT

A connector for memory cards includes a connector housing having an opening for receiving the memory card and at least one contact which contacts a connecting portion of the memory card inserted in the opening to connect the card to a computer circuit. According to the invention, the contact is arranged so as not to be in contact with the connecting portion of the memory card and there is provided a contact operating plate slidably movable in the connector housing to bring the contact into contact with the connecting portion of the memory card when the contact operating plate has moved toward said contact. The housing further comprises an operating lever pivotally connected thereto and having one end inserted into an aperture formed in the contact operating plate such that upon pivotally moving the operating lever, the contact operating plate is slidably moved in the housing. The operating lever is formed with a card restraining body angularly extending therefrom so as to suppress one end of the memory card inserted into the housing, thereby preventing inadvertent removal of the memory card. The housing is further provided at the opening with a closing plate pivotally connected thereto and spring means permitting the closing plate to bring into an opening position by the memory card being inserted into the opening but urging the closing plate into a closing position upon removal of the memory card from the opening, thereby preventing foreign material from entering the opening.

8 Claims, 7 Drawing Figures

CONNECTOR FOR MEMORY CARDS

BACKGROUND OF THE INVENTION

1. Field of the Invention

This invention relates to a connector for memory cards, which is able to connect the memory card with a circuit in an electric or electronic device such as a computer when the card is inserted into a card receiving opening provided in the computer.

2. Description of the Prior Art

Recently, personal computers have been widely used, which are able to carry out required processing such as tabulating and arithmetic operation without requiring any previous operation only by an insertion of a "so-called" memory card, wherein required programs have been memorized, into a card receiving opening provided in the computer. In this case, a connection between the memory card and a circuit in the computer is effected in the following manner.

FIG. 1 illustrates a typical memory card 3 in a perspective view which comprises an insulating casing 2 accommodating therein a memory plate 1 so as to permit its connecting portion 1*a* to be exposed at an opening or window 2*a* of the casing 2. The memory card 3 is inserted into a housing 6 of a memory card connector 5 secured to an opening 4*a* of a computer casing 4 so as to bring the connecting portion l*a* into contact with a plurality of contacts 7 in the housing 6 to achieve the connection between the memory plate and a circuit of the computer.

With this arrangement, contacting portions 7*a* of the contacts 7 extend into the interior of the opening 2*a* of the casing 2 with the aid of their strong spring forces in order to ensure the positive contact between the contacting portion of the memory card and the contacts. It is therefore required to force the memory card into the opening 2*a* of the casing 2 against the strong spring forces. There is a great tendency for the memory card 3 to be broken or damaged because it is not sufficiently thick to prevent such a damage. When the memory card 3 is being inserted, the contacting portions 7*a* of the contacts 7 having the strong spring forces can severely scrape the surface of the contacting portion 1*a* of the card impairing the electrical connection between the card and the contacts. In this arrangement of the prior art, furthermore, the opening 4*a* of the computer casing 4 remains opened after removal of the memory card, and therefore permits dust and other foreign particles in the air to enter the casing 4 which would accumulate therein to interfere with satisfactory operation of the computer.

SUMMARY OF THE INVENTION

It is a primary object of the invention to provide an improved connector for memory cards, which eliminates all the above mentioned disadvantages of the prior art.

It is a principal object of the invention to provide a connector for memory cards, which permits the memory card to be inserted into and removed from a device as a computer with slight force without any risk of damage of the card or scratches on its connecting portion and prevents failure due to entry of dust into an opening for the memory card and prevents inadvertent removal of the card to ensure reliable connection between the memory card and a computer circuit.

In order to achieve these object the connector for memory cards according to the invention includes a connector housing having an opening for receiving the memory card and at least one contact which contacts a connecting portion of the memory card inserted in said opening to connect the card to a computer circuit, wherein said contact is arranged so as not to be in contact with said connecting portion of said memory card and there is provided a contact operating plate slidably movable in said connector housing to bring said contact into contact with said connecting portion of said memory card when said contact operating plate has moved toward said contact.

In a preferred embodiment of the invention, the contact is provided with an obliquely folded portion and the contact operating plate is formed at its inner end with an oblique surface for urging the obliquely folded portion of the contact into contact with the connecting portion of the memory card by a cam action therebetween.

In another preferred embodiment of the invention, the housing further comprises an operating rod pivotally connected thereto and having one end extending from the pivoted point toward the housing, the one end being engageable in an aperture formed in the contact operating plate such that upon pivotally moving the operating rod, the contact operating plate is slidably moved in the housing.

The operating lever is preferably formed with a card restraining body angularly extending therefrom so as to suppress one end of the memory card inserted into the housing when the operating rod has been pivotally rotated so as to move the contact operating plate to bring the contact into contact with the memory card, thereby preventing inadvertent removal of the memory card.

In a further preferred embodiment of the invention, the housing is provided at the opening with a closing plate pivotally connected thereto and spring means permitting the closing plate to bring into an opening position by the memory card being inserted into the opening but urging the closing plate into a closing position upon removal of the memory card from the opening, thereby preventing foreign material from entering the opening.

The invention will be more fully understood by referring to the following detailed specification and claims taken in connection with the appended drawings.

DETAILED DESCRIPTION OF THE PREFERRED EMBODIMENT

Figure 1:
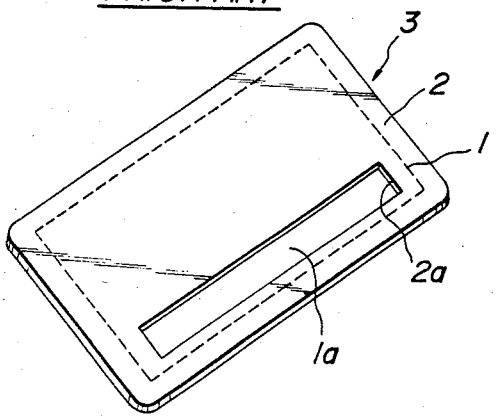
FIG. 1 PRIOR ART
FIG. 1 is a perspective view illustrating one example of a memory card.
Figure 2:
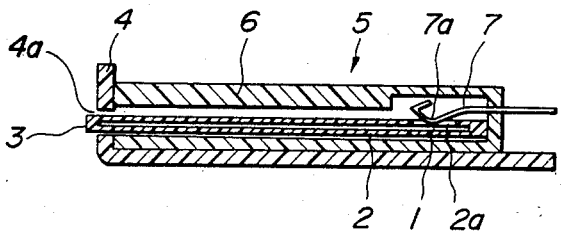
FIG. 2 PRIOR ART
FIG. 2 is a sectional view showing a connector for memory cards of the prior art.
Figure 3B:
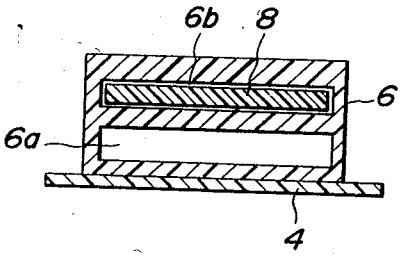
FIG. 3*b* is a sectional view taken along a line 3B—3B in FIG. 3*a;*
Figure 3C:
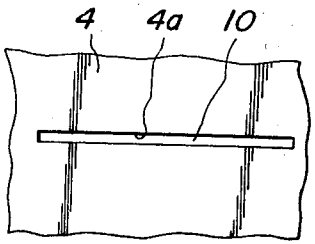
FIG. 3*c* is a partial front elevation of the connector as viewed in a direction of 3C—3C in FIG. 3*a;*
Figure 3A:
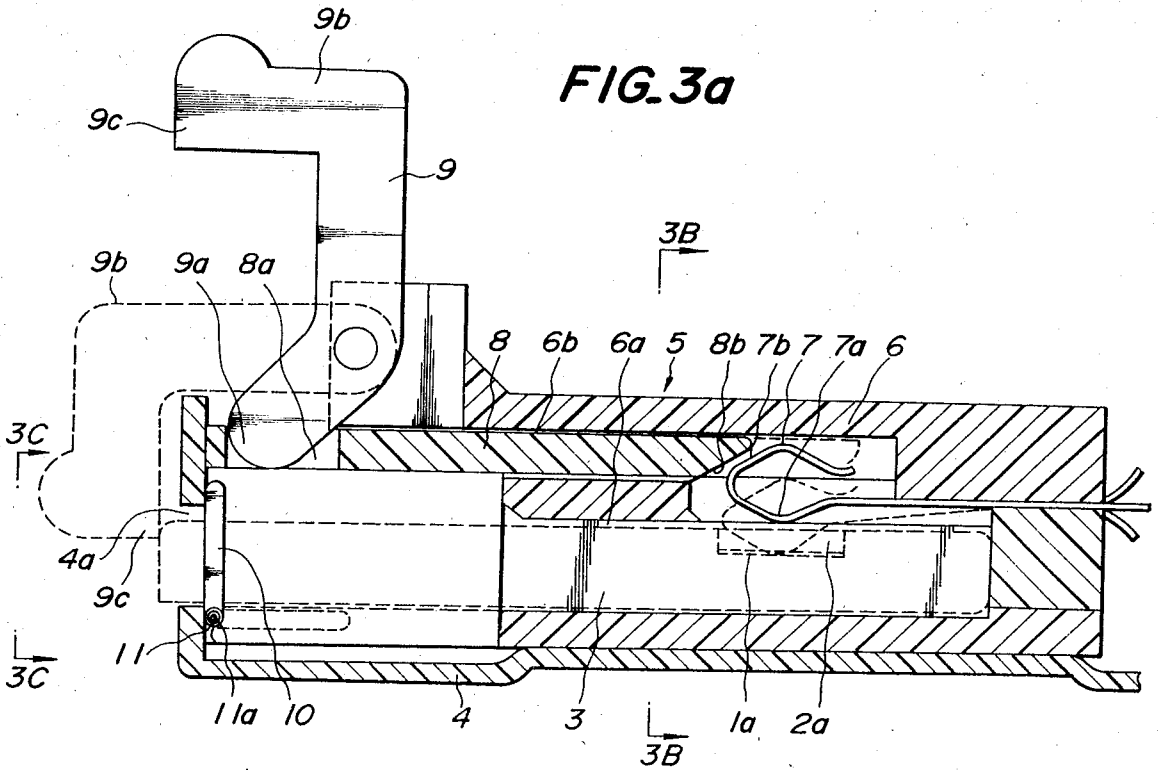
FIG. 3*a* is a sectional view illustrating one embodiment of the connector for memory cards according to the invention.

FIGS. 3*a*, 3*b* and 3*c* illustrate one embodiment of the invention, wherein like components have been designated by the same reference numerals as those in FIGS. 1 and 2. When a memory card 3 is inserted into an opening 6*a* of a housing 6 of a connector 5 according to the invention, contacting portions 7*a* of contacts 7 are not in contact with a contacting portion 1*a* of the card 3 exposed in its opening 2*a*. Not until the contacts 7 are urged toward the card are the contacting portions 7*a* are brought into contact with the contacting portion of the card. For this purpose, the contacts 7 to be fixed in the opening 6*a* of the housing 6 are provided with obliquely folded portions 7*b*, respectively. On the other hand, the housing 6 comprises a contact operating plate 8 guided by a support groove 6*a* formed in the housing 6 as shown in FIGS. 3*a* and 3*b*. The contact operating plate 8 is formed at its inner end with an oblique surface 8*b* adapted to urge the obliquely folded portions 7*b* of the contacts 7 so as to bring the contacting portions 7*a* thereof into contact with the contacting portion 1*a* of the card 3, when the contact operating plate 8 is moved in the inserting direction of the card. The housing 6 further comprises an operating lever 9 pivotally connected to the housing 6 and having one end 9*a* inserted within an aperture formed in an outer end of the contact operating plate 8.

When the operating lever 9 is rotated in a counter-clockwise direction from the position shown in solid lines to that in phantom lines in FIG. 3*a*, the contact operating plate 8 is displaced to the right by the end 9*a* of the operating lever 9. This displacement causes the oblique surface 8*b* of the inner end of the operating plate 8 to displace the contacting portions 7*a* of the contacts 7 by a cam action therebetween into contact with the contacting portion 1*a* of the memory card 3 as shown in phantom lines in FIG. 3*a*. By returning the operating lever 9 to the upright position the contact operating plate 8 is returned to its original position away from the contacts, so that the contacts 7 regain their initial positions out of contact with the memory card 3. In this manner, the memory card 3 can be inserted into and removed from the connector without requiring any force against the frictional resistance of the contacts, thereby preventing damages to the cards and scratches thereon during insertion and removal. Moreover, the contact operating plate 8 can be easily operated with slight force by suitably selecting a ratio of distances between the end 9*a* and the other end of the operating lever 9 respectively and the pivot point thereof.

In a preferred embodiment of the invention, the other end of the operating lever 9 is formed with a card restraining body 9*b* extending perpendicular to the main body of the lever 9 such that an end 9*c* of the card restraining body 9*b* is able to engage and secure one end of the memory card 3 extending from an opening 4*a* of a computer casing 4, when the lever 9 has been rotated into the position shown in phantom lines in a counter-clockwise direction as viewed in FIG. 3*a*, thereby preventing inadvertent removal of the memory card 3 from the casing 4.

In another preferred embodiment of the invention, the housing 6 is provided at its opening 6*a* with a closing plate 10 pivoted at its end about a shaft 11*a* to the casing 4 for closing the opening 4*a* of the computer casing 4 and with a spring 11 between the shaft 11*a* and the closing plate 10 for normally urging the plate 10 in the counter-clockwise direction as viewed in FIG. 3*a*. When the memory card 3 is inserted into the opening 4*a* of the computer casing 4, the closing plate 10 is urged by the card against the force of the spring 11 into the position shown in phantom lines shown in FIG. 3*a*. When the card 3 is removed, the spring 11 brings the closing plate 10 into its closing position shown in solid lines in FIG. 3*a*, thereby preventing dust or other foreign particles from entering the opening 4*a*. The closing plate 10 may be provided on its outer surface with a packing cloth, for example felt attached thereto so as to be in intimate contact with a face of the opening 4*a*.

Figure 4:
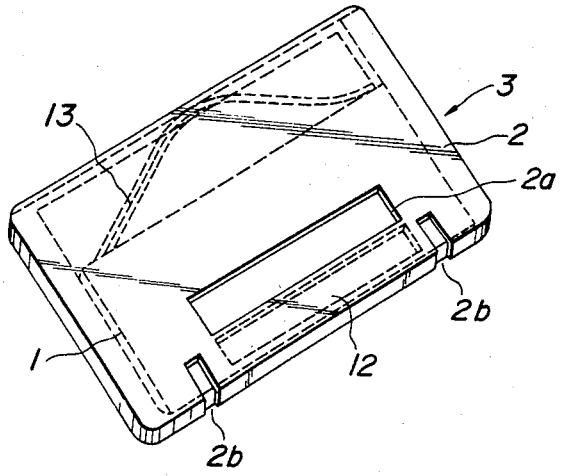
FIG. 4 is a perspective view of a memory card different in type from the memory card shown in FIG. 1.
Figure 5:
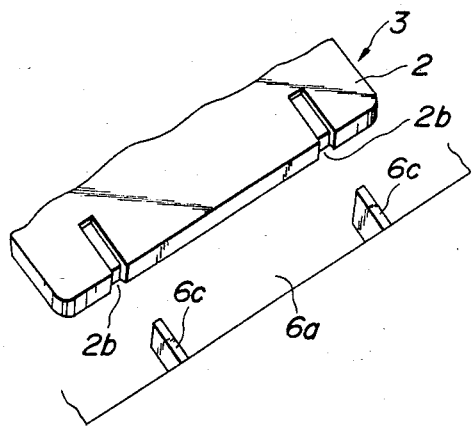
FIG. 5 is a partial perspective view of a modification of the connector for memory cards shown in FIG. 4 according to the invention.

A modified memory card 3 developed by Applicants' Assignee is shown in FIG. 4 and has been often used. The memory card 3 includes a memory plate 1 which is narrower relative to an insulating casing 2 to provide a space in the casing for accommodating a leaf spring 13. With such a memory card, when the memory plate 1 is engaged at notches 2*b* by an external force against the leaf spring 13, the memory plate 1 is moved to expose its connecting portion 1*a* to an opening or window 2*a*. Upon releasing the engagement of the memory plate at the notches 2*b*, the memory plate 1 is returned to its original position to conceal the contacting portion by a concealing portion 12 of the insulating casing 2.

When such a memory card having a spring therein is employed, two projections 6*c* are provided on a bottom of the opening 6*a* of the housing 6 so as to urge the memory plate 1 at the notches 2*b* when the card 3 is inserted into the housing 6.

As can be seen from the above description, with the connector for memory cards according to the invention, the memory card can be inserted into and removed from a device as a computer with slight force without any risk of damage of the card or scratches on its connecting portion. Moreover, the connector according to the invention is capable of preventing failure due to dust entered an opening for the memory card and preventing inadvertent removal of the card to ensure reliable connection between the memory card and a computer circuit.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A connector for memory cards of the type having a connecting portion for connection of the card to a computer circuit or the like, said connector comprising:

A. a housing having an opening for receiving said memory card;

B. at least one contact element for connection of the inserted card to said circuit, wherein said contact element is arranged so as normally to be not in contact with said connecting portion;

C. a contact operating plate movable within said housing to bring said contact element into contact with said connecting portion; and D. operating lever means pivotally connected to said housing, said lever means having one end extending from a pivot point thereof towards said housing, said end projecting into an aperture formed in said contact operating plate such that said lever means displaces said contact operating plate upon pivotal motion of said lever means, said lever means having a card-restraining body angularly extending therefrom, said body arranged to engage and restrain one end of said memory card inserted into said housing when said lever means has been pivotally rotated to move the contact operating plate and bring said contact element into contact with said connecting portion of said card, thereby preventing inadvertent removal of said card.

2. A connector for memory cards of the type having a memory plate and a contacting portion thereof resiliently biased within an insulating casing to conceal the contacting portion which is exposable for connection of the card to a computer circuit or the like, said connection comprising:

A. a housing having an opening for receiving said memory cards, said housing including at least one projection into the opening, the projection being engageable with said memory plate for displacement thereof to expose said contacing portion;

B. at least one contact element for connection of the inserted card to said circuit, wherein said contact element is arranged so as normally to be not in contact with said contacting portion of said card; and C. a contact operating plate movable within said housing to bring said contact element into contact with said contact portion of said card.

3. A connector as set forth in claim 2 wherein said contact element is provided with an obliquely folded portion and said contact operating plate is formed at its inner end with an oblique surface for urging a contacting portion of the contact element into contact with said connecting portion of said memory card by a cam action between the oblique portion and oblique surface.

4. A connector as set forth in claim 2, wherein said housing further comprises an operating lever pivotally connected thereto and having one end extending from the pivot point toward said housing, said one end being engageable in an aperture formed in said contact operating plate such that upon pivotally moving said operating lever, said contact operating plate is slidably moved in said housing.

5. A connector as set forth in claim 4, wherein said operating lever is so pivotally connected to said housing that the contact operating plate is movable by a slight force with the aid of a suitable ratio of distances between said one end engaging said contact operating plate and the other end of said operating rod.

6. A connector as set forth in claim 2, wherein said housing is provided at said opening with a closing plate pivotally connected thereto and spring means permitting said closing plate to bring into an opening position by the memory card being inserted into the opening but urging said closing plate into a closing position upon removal of the memory card from said opening, thereby preventing foreign material from entering said opening.

7. A connector as set forth in claim 6, wherein said spring means is a coil spring coiled about a pivotal shaft of said closing plate.

8. A connector as set forth in claim 6, wherein said closing plate is provided on its outer surface with a packing cloth so as to be in intimate contact with a face of the opening.

* * * * *